US008246375B2

(12) United States Patent
Heggemann et al.

(10) Patent No.: US 8,246,375 B2
(45) Date of Patent: Aug. 21, 2012

(54) CIRCUIT BOARD CLAMP MEANS

(75) Inventors: Christian Heggemann, Detmold (DE); Hans Schlingmann, Horn (DE); Sabine Schroeder, Lage (DE); Ulrich Luetkemeier, Detmold (DE); Joerg Muenstermann, Schlangen (DE); Wolfgang Sichmann, Huettenberg (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 13/063,271

(22) PCT Filed: Oct. 5, 2009

(86) PCT No.: PCT/EP2009/062876

§ 371 (c)(1),
(2), (4) Date: Mar. 26, 2011

(87) PCT Pub. No.: WO2010/040702

PCT Pub. Date: Apr. 15, 2010

(65) Prior Publication Data

US 2011/0165782 A1 Jul. 7, 2011

(30) Foreign Application Priority Data

Oct. 8, 2008 (DE) ..... 20 2008 013 227 U
Oct. 2, 2009 (DE) ..... 20 2009 011 104 U

(51) Int. Cl.
*H01R 4/24* (2006.01)

(52) U.S. Cl. ..... 439/409

(58) Field of Classification Search ..... 439/409, 439/410

See application file for complete search history.

(56) References Cited

U.S. PATENT DOCUMENTS

| | | | | |
|---|---|---|---|---|
| 2,145,556 | A | 1/1939 | Rypinski | |
| 4,995,830 | A * | 2/1991 | Eckhaus | 439/409 |
| 5,482,475 | A | 1/1996 | Kawaguchi | |
| 5,855,492 | A * | 1/1999 | Abe et al. | 439/417 |
| 6,074,238 | A * | 6/2000 | DeRoss et al. | 439/409 |
| 6,152,760 | A * | 11/2000 | Reeser | 439/409 |
| 6,406,324 | B1 * | 6/2002 | Duesterhoeft et al. | 439/409 |

FOREIGN PATENT DOCUMENTS

| | | | |
|---|---|---|---|
| DE | 3426212 | A1 | 1/1986 |
| DE | 3445718 | A1 | 6/1986 |
| DE | 3911108 | A1 | 10/1990 |
| DE | 4212710 | A1 | 10/1993 |
| FR | 2300432 | A1 | 9/1976 |
| GB | 1183608 | A | 3/1970 |

* cited by examiner

*Primary Examiner* — Gary F. Paumen
(74) *Attorney, Agent, or Firm* — Lawrence E. Laubscher, Sr.; Lawrence E. Laubscher, Jr.

(57) ABSTRACT

An electrical connector for connecting the bare end of a horizontal conductor with a horizontal printed circuit board, including a sectional housing having a base member seated on the printed circuit board. The base member contains an open-topped chamber and includes a vertical front wall the upper edge of which contains a vertical slot communicating with the chamber. A cover member is normally seated on the base member to close the chamber and the upper end of the slot. A lower electrically conductive cage member is arranged in the bottom of the chamber for electrical connection with the printed circuit board. The cover member is removable from the base member to open the tops of the chamber and the slot, thereby to permit the horizontal conductor bare end to be displaced laterally vertically downwardly into the slot and housing chamber toward electrical engagement with the lower cage member.

7 Claims, 4 Drawing Sheets

CIRCUIT BOARD CLAMP MEANS

REFERENCE TO RELATED APPLICATIONS

This application is a continuation of International application No. WO 2010/040702A1, based on the PTC application No. PCT/EP2009/062,876 filed Oct. 5, 2009, claiming priority of the German applications Nos. DE 20 2008 013 227.4 filed Oct. 8, 2008, and 20 2009 011 104.0 filed Oct. 2, 2009.

BACKGROUND OF THE INVENTION

1. Field of the Invention

An electrical connector for connecting the bare end of a horizontal conductor with a horizontal printed circuit board, including a sectional housing having a base member seated on the printed circuit board. The base member contains an open-topped chamber and includes a vertical front wall the upper edge of which contains a vertical slot communicating with the chamber. A cover member is opened from a closed position relative to the base member, thereby to permit the conductor bare end to be displaced laterally vertically downwardly into the slot and housing chamber toward electrical engagement with a conductive cage member arranged in the bottom of the chamber.

2. Description of Related Art

The state of the art offers the most varied models of printed circuit board connectors and clamping devices binders for the connection of electrical conductors having the most widely varying diameters, and sizes.

One encounters a problem when connecting conductors with a relatively large diameter; the problem is that the conductors, which are rather stiff very often due to their relatively large diameter, are difficult to insert into the printed circuit board connectors.

The present invention was developed to avoid the above and other drawbacks of the known printed circuit connectors.

SUMMARY OF THE INVENTION

Accordingly, a primary object of the present invention is to provide an electrical connector for connecting the bare end of a horizontal conductor with a horizontal printed circuit board, including a sectional housing having a base member adapted to be seated on the printed circuit board, said base containing an open-topped chamber and having a vertical front wall the upper edge of which contains a vertical slot communicating with the chamber. A cover member is removably seated on the base member to close the chamber and the upper end of the slot. A lower electrically conductive cage member is arranged in the bottom of the chamber for electrical connection with the printed circuit board. The cover member is removable from the base member, thereby to permit the conductor bare end to be displaced laterally vertically downwardly into the slot and housing chamber toward electrical engagement with the lower cage member.

According to another object of the invention, locking means are provided for locking the cover member to the base member when the cover member is in the closed position. When the cover member is pivotally connected with the base member, auxiliary locking means may be provided for locking the cover member in the open position.

Another object is to provide clamping means on the cover member for displacing the conductor bare end toward engagement with the lower conductive cage member.

The present invention definitely simplifies the insertion of the conductors because it is now possible to insert the conductors laterally—preferably from the upper, initially open side—into the initially open housing, whereupon the latter is closed and the connection, which is preferably made as a screw connection, is then "firmly screwed in" so as to establish a well-conducting contact. Advantageously, it is therefore no longer necessary to deform or bend the conductors or conductor ends for the purpose of threading them into the contact point.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
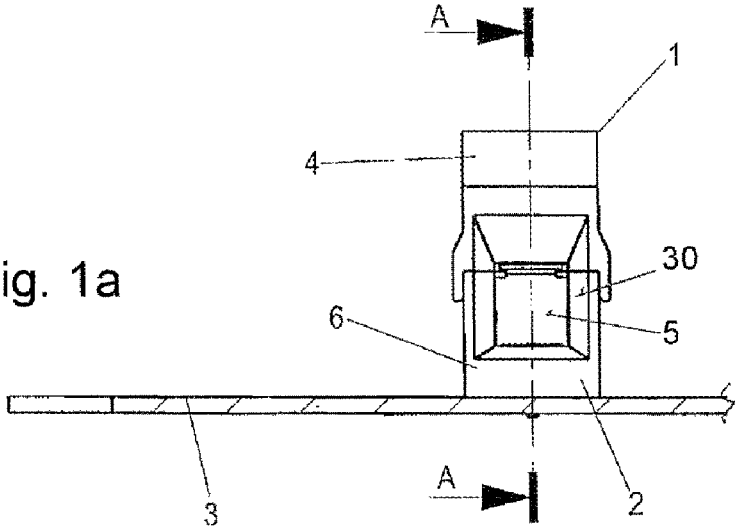
FIG. 1*a* is a front elevation view of the connector housing mounted on a printed circuit board.
Figure 1B:
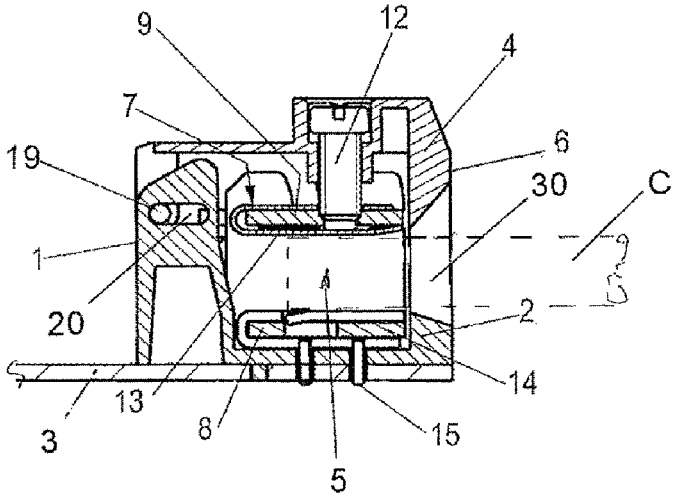
FIG. 1*b* is a sectional view taken along line A-A of FIG. 1*a;*

Referring first to FIGS. 1*a* and 1*b*, the connector apparatus of the present invention includes a sectional housing 1 having a base member or section 2 having a horizontal bottom surface that is seated on a horizontal printed circuit board 3. The base member 2 contains an open-topped chamber 5, and a front end wall 6 the upper edge of which contains a vertical slot 30 in communication with the chamber. A housing cover member or section 4 is normally in the closed position of FIG. 1*b*, closing the top of the chamber 5 and the upper end of slot 30.

Arranged in the hosing chamber 5 is a metal clamping cage 7 including a U-shaped conductive lower cage member 8 having a bottom wall 14 that is electrically connected with the circuits of the printed circuit board by the conductive pins 15. An upper cage clamping member 9 is vertically displaceable in the chamber 5 by means of a clamping screw 12 that is threadably connected in an opening contained in the cover member 4. The cover member 4 is pivotally connected with the base member 2 by means of a pivot shaft 19 that extends at each end into a horizontal slot 20 contained in the base member. The cover member is thus connected for pivotal displacement from the horizontal closed position of FIG. 1*b* to the vertical open position of FIG. 2.

Figure 2:
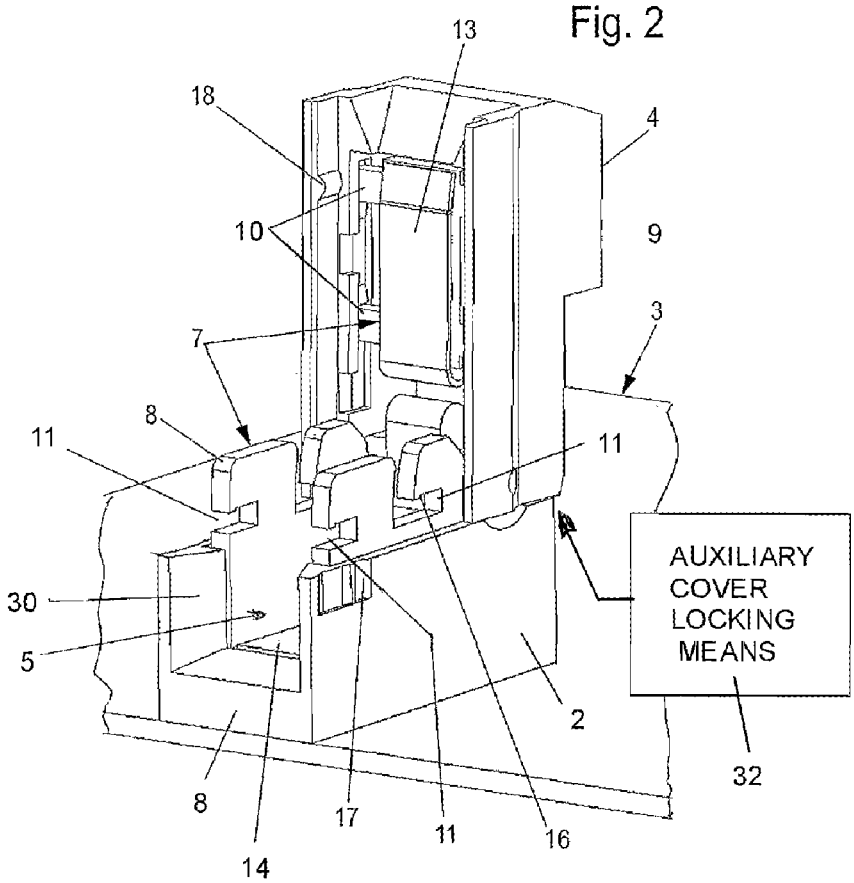
FIG. 2 is a front perspective view of the apparatus of FIG. 1*b* with the cover member in the open position relative to the housing base member.

According to a characterizing feature of the present invention, when the cover member is in the open position of FIG. 2, the horizontal conductor C may be displaced laterally downwardly to cause the horizontal bare end of the conductor to extend downwardly through the vertical slot 30 contained in the housing front wall 6, and downwardly into the housing chamber 5 toward electrical engagement with the bottom wall 14 of the lower cage member 8, thereby to connect the conductor bare end with one or more circuits on the circuit board 3 via the contact pins 15. It is thus not necessary to insert the bare conductor end axially into a contact point.

Figure 3:
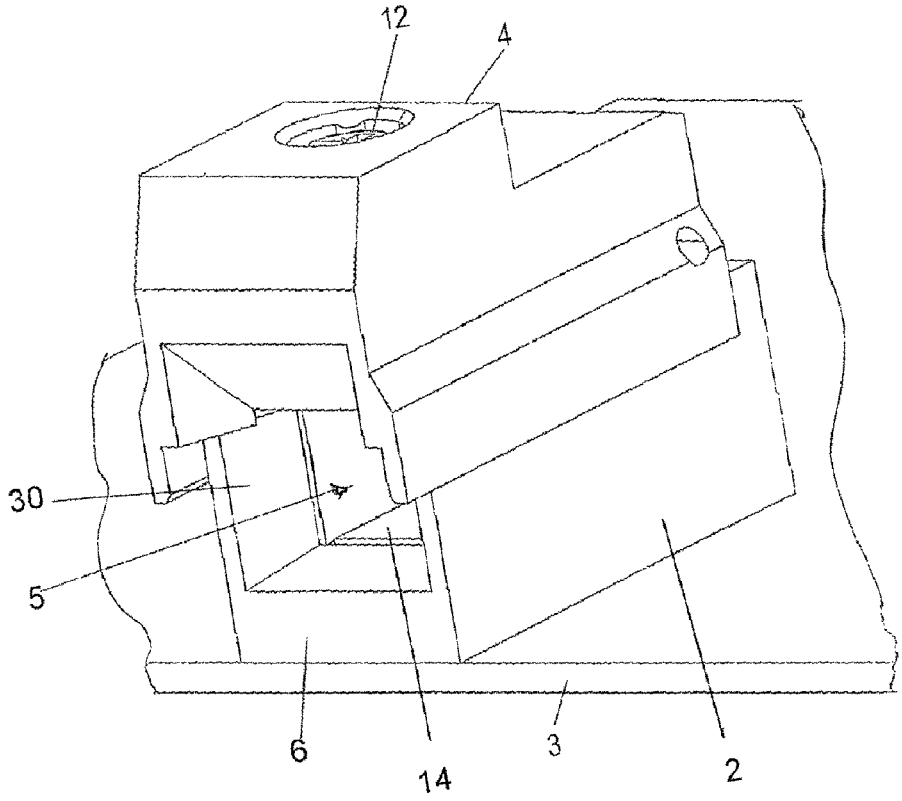
FIG. 3 is a front perspective view of the apparatus of FIG. 2 with the cover member pivoted to the closed position relative to the base member.

Following the lateral downward insertion of the conductor C into the chamber 5, the cover member 4 is manually pivoted downwardly toward the closed position of FIG. 3, thereby to close the top of chamber 5 and the upper end of the vertical slot 30. In order to lock the cover member to the base member, the cover member is then longitudinally displaced toward the pivot shaft (as permitted by the horizontal slot 20) and toward the locked position of FIG. 4, whereupon horizontal locking tabs 10 on the upper cage member 9 extend within corresponding horizontal locking slots 11 contained in the vertical side walls of the lower cage member 8. During this horizontal longitudinal displacement of the cover member 4 toward the pivot shaft 19, projections 18 on the cover member extend with an audible clicking sound into corresponding vertical grooves 17 formed on the outer surfaces of the side walls of the base member 2. The clamping screw 12 is then rotated to displace the upper clamping cage member 9 downwardly, thereby to clamp the conductor C in engagement with the bottom wall 14 of the lower clamping cage member 8.

According to another feature of the invention illustrated in FIG. 2, auxiliary locking means 32 may be provided for locking the cover member 4 in the open vertical position. These auxiliary locking means may comprise projection and groove locking means corresponding with the projection and groove locking means 17 and 18.

Instead of the pivot shaft and slot pivot means of FIG. 2, one could conceivably also bring about the pivot action by means of a film hinge. This variant makes it possible to design the housing in one piece as a synthetic plastic injection molding part. But one can also make a plastic housing that consists of several parts.

It is advantageous, but it is not compulsory, to make sure that the housing base segment 2 and the housing lid segment 4 are connected with each other in a pivotal manner. It is also conceivable, however, that one might design them so that they will simply be removable with relation to each other.

In a particularly preferred manner, a pivotal and limitedly pivotal motion is permitted by means of a sufficiently long dimensioned film hinge between the housing base segment and the housing lid segment 2, 4. This preferred design is particularly advantageous—as we can see below.

According to FIGS. 1 and 2, the cage base segment 8 and the cage lid segment 9 are provided with corresponding locking means 10, 11 that can be engaged with each other and disengaged from each other and that in this case are made in each case as two grooves 11 that are made in the side walls of the cage base segment 8 and as corresponding lateral bridges 10 on the cage lid segment 9, whereby in each case one of the grooves 11 is opened parallel toward the printed circuit board plane and where one of the grooves 11 is made L-shaped.

After the insertion of a conductor into the position with opened or, in this case, housing lid segment 4 swung into the open position (FIG. 2) in which the cage lid segment 9, arranged on the housing lid segment 4 in this case, is completely separated from the cage base segment 8, the housing lid segment 4 with the cage lid segment 9 is folded down into a position that is parallel to the printed circuit board 3 (FIG. 3). In this position, the locking means 10, 11 are flush with each other and locking tabs 10 engage the rear grooves 11 into the base legs of these L-shaped grooves 11.

Figure 4:
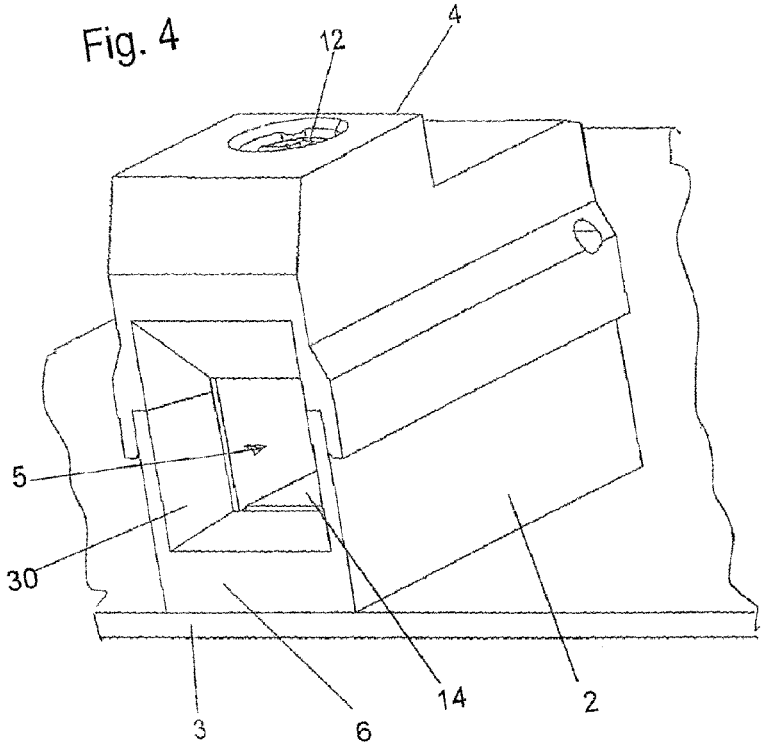
FIG. 4 is a front perspective view of the apparatus of FIG. 2 with the cover member horizontally displaced to the locked position relative to the base member.

Thereupon, housing lid segment 4 with the cage lid segment 9 is shifted parallel to the printed circuit board plane, whereby the form-locking means 10, 11 will so engage each other that the binder cage will be closed (FIG. 4). Thereupon, it is merely necessary to bring about the clamping conductor connection to tighten a clamping screw 12, which preferably in a rotary manner passes through the cage lid segment 9, whose end in the interior of the clamping cage preferably acts upon an elastically designed clamp strap 13 that grasps around the cage lid segment 9 or is fixed upon it in a relatively movable manner and then firmly to clamp the conductor end in the binder cage 7 by screwing. The clamp strap 13 can optionally be made as traction strap or pressure strap. It can furthermore act as a wire shield.

At least one of the walls of binder cage 7 is so designed in a well-conducting manner that it will act as a current-conducting element. Preferably, we use for this purpose the base wall 14 of the binder cage 7 that faces toward the printed circuit board 3 and that is covered with a conducting piece of sheet metal, which again preferably directly or via connection pins 15 is connected in a conducting manner and by means of soldering with the printed circuit board 3 and which is fixed upon the latter.

Between locking means 10, 11, one can optionally make a locking lock (catch edge 16) in order to make sure that the binder cage 7 will remain securely closed even when roughly handled.

It is further conceivable that the housing base segment 2 and the housing lid segment 4 engage each other on locking means 17, 18 and/or on catch means after the insertion of the conductor and the attainment of the "clamping state" (FIG. 4) in a supplementary locking manner in order to block the relative shifting movement between these elements.

According to another advantageous variant, the housing lid segment 4 is locked in the open state also upon housing base segment 2 so that we have a defined open position here.

It might be noted with regard to the previously described differing optional catch functions that, preferably between the lockable structural elements, in each case we make a tangible and/or audible catch so that the user will know for sure that after the locking of the conductors, the conductors can be clamped firmly with the screw 12.

In view of its simple, cheap structure, the inventive screw connection is outstandingly suitable for the connection also of relatively inflexible conductors, which—depending on the design—may also have larger diameters.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector for connecting the horizontal bare end of a conductor (C) with a circuit of a horizontal printed circuit board (3), comprising:

(a) a housing (1) formed of electrical insulating material, said housing being sectional and including:

(1) a base member (2) having a horizontal bottom wall adapted to be seated on the printed circuit board, said base member containing an open-topped chamber (5), said base member having a vertical front wall (6) the upper edge of which contains a vertical slot (30) communicating with said chamber;

(2) a cover member (4):

(3) pivot means (19, 20) connecting said cover member for pivotal displacement between a normally closed position seated on said base member to close said chamber and the upper end of said slot, and an open position relative to said chamber and said slot;

(b) electrical contact means (8) arranged in the bottom of said chamber for electrical connection with the printed circuit board, whereby when said cover member is in said open position, the horizontal bare end of a conductor may be displaced laterally downwardly into said slot and into said housing chamber for engagement with said electrical contact means;

(c) said cover member being connected with said base member for longitudinal horizontal displacement between said closed position and a locked position relative to said base member;

(d) first locking means (10, 11) for locking said cover member against vertical displacement relative to said base member when said cover member is in said locked position.

2. An electrical connector as defined in claim 1, wherein said first locking means includes at least one horizontal locking tab (10) mounted on one of said housing and cover and base members for locking engagement with a corresponding horizontal locking slot (11) contained in the other of said housing and base members when said cover member is in said locked position.

3. An electrical connector as defined in claim 2, and further including (e) second locking means (17, 18) for resisting horizontal displacement of said cover member from said locked position towards said closed position.

4. An electrical connector as defined in claim 3, wherein said second locking means includes at least one locking projection (18) arranged on one of said housing cover and base members for locking engagement with a corresponding vertical locking groove (17) contained in the other of said housing cover and base members when said cover member is in said locked position.

5. An electrical connector as defined in claim 4, wherein said second locking means is operable to produce an audible sound when said cover member is displaced from said closed position toward said locked position.

6. An electrical connector as defined in claim 1, and further including:

(e) auxiliary locking means (32) for locking said cover member in said open position relative to said base member.

7. An electrical connector as defined in claim 2, wherein said electrical contact means comprises conductive metal clamping cage means (7) including:

(1) a conductive lower cage member (8) mounted in the bottom of said housing chamber;

(2) pin means (15) electrically connecting said lower cage member with the printed circuit;

(3) a clamping screw (12) threadably connected for vertical displacement relative to said cover member when said cover member is in the closed position; and (4) an upper cage member (9) connected with said clamping screw for insertion within said chamber when said cover member is in the locked position, said upper cage member being downwardly displaceable in said chamber by said clamping screw to clamp the conductor bare end in engagement with said lower cage member.

* * * * *